United States Patent [19]

Matejec et al.

[11] Patent Number: 4,724,197

[45] Date of Patent: Feb. 9, 1988

[54] COLOR PHOTOGRAPHIC RECORDING MATERIAL AND A PROCESS FOR THE PRODUCTION OF COLOR PHOTOGRAPHIC IMAGES

[75] Inventors: Reinhart Matejec; Wolfgang Himmelmann, both of Leverkusen; Günter Helling, Odenthal, all of Fed. Rep. of Germany

[73] Assignee: Agfa Gevaert Aktiengesellschaft, Leverkusen, Fed. Rep. of Germany

[21] Appl. No.: 868,947

[22] Filed: May 30, 1986

[30] Foreign Application Priority Data

Jun. 11, 1985 [DE] Fed. Rep. of Germany ..... 3520845

[51] Int. Cl.[4] ..... G03C 1/46

[52] U.S. Cl. ..... 430/377; 430/505; 430/509; 430/627; 430/628; 430/642; 430/546; 430/506

[58] Field of Search ..... 430/505, 506, 509, 627, 430/628, 642, 546, 377

[56] References Cited

U.S. PATENT DOCUMENTS

| | | | |
|---|---|---|---|
| 4,199,363 | 4/1980 | Chen | 430/377 |
| 4,266,010 | 5/1981 | Nagatomo et al. | 430/642 |
| 4,481,288 | 11/1984 | Yamada et al. | 430/509 |

FOREIGN PATENT DOCUMENTS

| | | | |
|---|---|---|---|
| 0174871 | 3/1986 | United Kingdom | 430/509 |

*Primary Examiner*—Paul R. Michl
*Assistant Examiner*—Patrick Doody
*Attorney, Agent, or Firm*—Connolly and Hutz

[57] ABSTRACT

A color photographic recording material contains at least one silver halide emulsion layer which is divided into a partial layers of different sensitivity, at least one relatively high-sensitivity partial layer containing a synthetic polymer and gelatin in a ratio by weight of from 30:70 to 80:20.

8 Claims, No Drawings

COLOR PHOTOGRAPHIC RECORDING MATERIAL AND A PROCESS FOR THE PRODUCTION OF COLOR PHOTOGRAPHIC IMAGES

This invention relates to a photographic recording material having improved sensitometric properties.

Photographic recording materials are required to show high sensitivity, good sharpness and fine graininess. To this end, it is already known to divide up emulsion layers into partial layers of different sensitivity, to use antihalation dyes and DIR-compounds and, for example, to reduce graininess by a limited diffusion of dyes.

In addition, it is known that synthetic polymeric compounds may be used instead of the gelatin predominantly used as binder. Synthetic polymers may also be used as peptizing agents or as carriers for hydrophobic substances, for example in the form of loaded latices, cf. U.S. Pat. No. 4,199,363. In some cases, excellent graininess is obtained in this way, cf. DE-A No. 3 036 846 and EP-A No. 93 924.

The use of polymers is comprehensively reported in Research Disclosures Nos. 19 551, 20 502, 18 735, 18 549, 17 709, 17 329 and 15 638. Reference is also made in this connection to DE-A No. 2 745 287, U.S Pat. Nos. 3,411,911, 3,536,491, 2,852,386, 2,772,153, DE-A Nos. 1 472 746, 1 522 387, EP-A No. 69 671, U.S. Pat. Nos. 2,272,191 and 2,772,163.

Polymers such as these may be charged with color couplers, as known for example from DE-A Nos. 2 541 274, 2 541 230, 2 541 276, EP-A No. 0 014 921, U.S. Pat. No. 4,133,687, EP-A No. 0 069 671, DD No. 144 129, EP-A No. 0 130 115, DD No. 138 831, DE-A Nos. 2 820 092, 1 597 467, U.S. Pat. No. 4,291,113, GB-A No. 2 072 365, DE-A No. 2 835 856, GB-A No. 1 516 855, DE-A Nos. 3 036 846, 2 815 635.

Unfortunately, the known measures are still attended by disadvantages in regard to their sensitometric properties and particularly in regard to sharpness combined with good graininess and sensitivity.

Accordingly, the object of the present invention is to provide a color photographic recording material having improved properties which is intended to show in particular improved sharpness, but also good graininess and sensitivity.

Applicants have now found a color photographic recording material comprising at least one silver halide emulsion layer which is divided into a relatively non-sensitive partial layer L and at least one more sensitive partial layer H, at least one color coupler being associated with the partial layers H and L. According to the invention, at least one partial layer H contains at least one synthetic polymer P and gelatin, the ratio by weight of all synthetic polymers P and gelatin in this partial layer being from 30:70 to 80:20.

In one particularly preferred embodiment, the ratio by weight is at least 40:60 and, in another embodiment, from 40:60 to 60:40.

In another particularly preferred embodiment, the partial layer H contains a low molecular weight color coupler whilst a low molecular weight and/or polymeric coupler is associated with the partial layer L.

Applicants have also found a process for the production of color photographic images in which the recording material according to the invention is exposed imagewise and is developed in a color developer. The color developer preferably contains a p-phenylene diamine.

In the context of the present invention, synthetic polymers are preferably understood to be synthetic high molecular weight compounds from the group comprising polymerization products, polycondensation products and polyaddition products.

Polymerization products are preferably polymers of ethylenically unsaturated low molecular weight compounds and polymers of low molecular weight compounds which have a ring structure.

Examples of ethylenically unsaturated compounds are ethylene, butadiene, isoprene, aromatic vinyl compounds, such as styrene, α-methylstyrene, divinylbenzene, chloromethyl styrene, vinyl toluene, (meth)acrylic acid derivatives, such as optionally substituted (meth)acrylic acid esters, (meth)acrylic acid amides, (meth)acrylic acid, vinyl esters, vinyl amides, vinyl ethers, heterocyclic vinyl compounds i.a. vinyl pyridine, vinyl imidazole, vinyl sulfones, vinyl sulfonamides, vinyl ketones, maleic acid derivatives, fumaric acid derivatives, itaconic acid derivatives, (meth)allyl compounds, vinyl thioethers, vinyl silanes, vinyl chloride, vinylidene chloride, (meth)acrylonitrile.

Examples of the classes compounds mentioned above can be found in Research Disclosure 19 551 (1980) and in Yocum, Nyquist "Functional Monomers", 2nd Vol., New York, Dekker 1973.

Low molecular weight compounds which have a ring structure are, for example, ethylene oxide, propylene oxide, butylene oxide, aziridines, tetrahydrofuran, caprolactam, epichlorohydrin.

Examples of polycondensation products and polyaddition products are polyesters, polyamides, polycarbonates, polysulfones, polyurethanes, polysiloxanes, polyureas, phenol-formaldehyde resins, polyimides, polyphenylene oxide, epoxy resins, urea-formaldehyde resins. Examples of these compounds can be found in Ullmanns Encyklopadie der technischen Chemie, 4th Edition, Vol. 19, Verlag Chemie, Weinheim 1980.

Particularly preferred synthetic polymers are the nonionic polyurethanes known from DE-PS No. 1 522 387, the anionic polyurethanes known from DE-PS No. 1 522 393 which contain a phosphonic acid, phosphoric acid ester of phosphoric acid amide group capable of salt formation and the anionic polyurethanes known from DE-PS No. 1 472 746.

It is preferred to use polymers which are present in dispersion form, i.e. which have a particulate character, the average particle size being from 20 to 2000 nm and preferably from 20 to 500 nm.

In addition, polymers having a glass transition temperature $T_g$ below +25° C. are preferred.

In addition, polymer dispersions which are nonionic or which have an anionic charge are preferred.

Other preferred polymers are those which have a certain dissolving power for the color coupler used. The color coupler may be regarded as being soluble in a polymer if a polymer/coupler mixture prepared by concentrating a solution of polymer and coupler by evaporation does not show any fusion enthalpy of the coupler in differential thermoanalysis. Polymers capable of dissolving more than 5% of color coupler are particularly suitable.

The polymers are used in such a way that they allow limited diffusion of the dye formed from the color coupler during the color coupling reaction.

Loadable latices are preferably used. The polymers described in DE-A Nos. 3 036 846, 1 522 387 and 1 472 746 are particularly suitable. Preferred examples of polymers are L1 to L180 from Research Disclosure 19 551, polymer I to polymer V from DE-A No. 3 036 846 and the polyesters from EP No. 0 069 671, page 6, line 33 to page 7, line 22.

Particularly preferred polymers are shown in the following. In some cases, they are loaded with couplers.

Polymer P1:

Polymer II of DE-A No. 30 36 846 or U.S. Pat. No. 4,388,403 is loaded with the color coupler C2 described in the following in a ratio of polymer to coupler of 8:1. The procedure adopted is as described for dispersion 1 in DE-A No. 3 036 846.

Polymer P2:

Polymer P2 is prepared in the same way as polymer P1, except that instead of the coupler mentioned there the magenta coupler M1 described in the following is used.

Polymer P3:

Polymer IV of DE-A No. 3 036 846 is loaded in a ratio by weight of 8:1 with the yellow coupler Y1 described in the following using the procedure described for dispersion IV in DE-A No. 3 036 846.

Polymer P4:

Prepared in the same way as polymer V of DE-A No. 3 036 846 which is loaded in a ratio by weight of 1:1 with the coupler described in the following using the procedure described for dispersion IV in DE-A No. 3 036 846.

Polymer P5:

Prepared in the same way as polymer II of DE-A No. 3 036 846 which is loaded in a ratio by weight of 1:1 with the magenta coupler M2 described in the following using the procedure described for dispersion IV in DE-A No. 3 036 846.

Polymer P6:

Compound 4 of DE-PS No. 1 472 746 which is loaded in a ratio by weight of 1:1 with the yellow coupler Y1 described in the following using the procedure described for dispersion IV in DE-A No. 3 036 846 for loading.

Polymer P7:

Compound 2 of DE-PS No. 1 472 746.

Polymer P8:

Compound 5 of DE-PS No. 1 472 746.

The polymers mentioned above are added in particular to the highly sensitive partial layers of a color negative material. In addition to silver halide, the highly sensitive partial layers may contain color masks, white couplers, scavengers, DIR-couplers and also DAR-couplers. A combination of the polymers mentioned in the highly sensitive partial layers with DIR couplers is particularly advantageous because it increases sharpness through edge effects. A combination of these polymers with DAR (development accelerator release) couplers counteracts grain enlargement.

In addition, the highly sensitive partial layers may also contain casting aids, such as wetting agents and thickeners, etc.

In one particularly preferred embodiment, at least some of the polymers used in accordance with the invention are used as carriers for a color coupler. In this case, therefore, the latex present is loaded with a coupler. In this case, it may be of particular advantage to use a mixture of charged and uncharged latex.

The polymers P used in accordance with the invention are present to a far lesser extent, if at all, in the layer L of low sensitivity. Otherwise, the partial layer L may contain the usual constituents, i.e.—in addition to the silver halide emulsion—color couplers, masks, competing couplers, scavengers, DIR-couplers and/or DAR-couplers. These constituents, particularly the color couplers, may also be absorbed onto or into a latex in the layer of low sensitivity so that the latex is present as a loaded latex. The couplers may also be fixed in the form of polymeric couplers.

However, the ratio of polymer to gelatin in the partial layer L is preferably lower than 25:75. The coupler-to-silver ratio in the layer L of low sensitivity is normally greater than in the partial layer H of relatively high sensitivity.

In one preferred embodiment, the recording material according to the invention contains at least one blue-sensitive layer, at least one green-sensitive layer and at least one red-sensitive layer, of which at least one layer is divided up in accordance with the invention into two partial layers L and H. In a particularly preferred embodiment, all the spectrally sensitized layers are divided up into at least two partial layers of different sensitivity.

The partial layers having the same spectral sensitivity may be combined—lying adjacent one another—to form double-layer or multilayer packs, although the partial layers of one spectral sensitivity may also alternate with the layers of another spectral sentivity in any sequence which produces the most advantageous constellation.

In a preferred embodiment, at least one blue-sensitive layer lies above the green-sensitive and red-sensitive layers and is separated therefrom by a yellow filter layer. In addition to the photosensitive layers, it is possible to use other protective and intermediate layers.

Layer compositions in which at least one emulsion layer is divided up into partial layers of different sensitivity are known, for example, from DE-A No. 1 958 709 (Pankow).

Typically useable compositions are shown in the following, the usual intermediate layers having been ommitted in the interests of clarity. The abbreviations used have the following meanings:

r, red-sensitive partial layer, low sensitivity
R, red-sensitive partial layer, average sensitivity
RR, red-sensitive partial layer, maximal sensitivity,
g, green-sensitive partial layer, low sensitivity,
G, green-sensitive partial layer, average sensitivity,
GG, green-sensitive partial layer, maximal sensitivity,
b, blue-sensitive partial layer, low sensitivity,
B, blue-sensitive partial layer, average sensitivity,
BB, blue-sensitive partial layer, maximal sensitivity,
YF, yellow filter
Sp, support.

| Compositions: | | | | |
|---|---|---|---|---|
| I | II | III | IV | V |
| | | BB | BB | |
| | | b | b | |
| | | | YF | |
| BB | BB | GG | GG | BB |
| b | b | RR | RR | b |
| YF | YF | YF | YF | YF |
| GG | GG | G | G | GG |
| g | RR | R | g | G |
| | | | | g |
| RR | g | g | R | RR |
| r | r | r | r | R |

-continued

| Compositions: | | | | |
|---|---|---|---|---|
| I | II | III | IV | V |
| | | | | r |
| Sp | Sp | Sp | Sp | Sp |

The sensitivity of the individual partial layers is not assessed on the basis of absolute sensitivity, but rather on the basis of effective sensitivity taking into account the particular position within the color photographic multilayer material. The difference in effective sensitivity is best between 0.1 and 1.0 relative log Ixt-units. In individual cases, the sensitivity difference is selected in such a way that a balanced gradation curve without any noticeable distortion is obtained during color photographic processing.

In addition to the layers already mentioned, the color photographic recording material according to the invention may contain other, non-photosensitive auxiliary layers, for example adhesion layers, antihalation layers or cover layers, particularly intermediate layers between the photosensitive layers which are intended effectively to prevent the diffusion of developer oxidation products from one layer into another. To this end, intermediate layers of the type in question may also contain certain compounds which are capable of reacting with developer oxidation products. Layers such as these are preferably arranged between adjacent photosensitive layers of different spectral sensitivity. These intermediate layers may also contain a silver halide emulsion of low sensitivity (average crystal diameter approximately 0.1 μm or smaller) which contains chloride, bromide and optionally iodide. A layer such as this has a particularly beneficial effect on the sensitivity of the adjoining layers. However, the silver halide emulsion of low sensitivity may also be directly introduced into the photosensitive layers.

Color couplers capable of reacting with color developer oxidation products to form a dye are preferably associated with the photosensitive silver halide emulsion layers. The color couplers are preferably present immediately adjacent to and, more preferably, in the silver halide emulsion layer.

Thus, the red-sensitive layer may contain, for example, a color coupler for producing the cyan component color image, generally a coupler of the phenol or α-naphthol type. The green-sensitive layer may contain, for example, at least one color coupler for producing the magenta component color image, color couplers of the 5-pyrazolone type normally being used.

The blue-sensitive layer may contain, for example, at least one color coupler for producing the yellow component color image, generally a color coupler containing an open-chain ketomethylene group. The color couplers may be, for example, 6-, 4- and 2-equivalent couplers. Suitable couplers are known, for example, from the publications entitled "Farbkuppler (Color Couplers)" by W. Pelz in "Mitteilungen aus den Forschungslaboratorien der Agfa, Leverkusen/Munchen", Vol. III, page 111 (1961); K. Venkataraman in "The Chemistry of Synthetic Dyes", Vol. 4,341 to 387, Academic Press (1971) and T. H. James, "The Theory of the Photographic Process", 4th Edition, pp. 353–362 and also from the journal Research Disclosure No. 17643 of December, 1978, Chapter VII, published by Industrial Opportunities Ltd., Homewell/Havant, Hampshire, PO9 1 EF, Great Britain. The usual masking couplers may be used for improving color reproduction. In addition, the recording material may contain DIR-compounds and white couplers which do not produce a dye on reaction with color developer oxidation products. The inhibitors releasable from the DIR-compounds may be released either directly or by way of non-inhibiting intermediate compounds. Reference is made in this connection to GB 953 454, U.S. Pat. Nos. 3,632,345, 4,248,962 and GB No. 2 072 363 and to Research Disclosure No. 10226 of October, 1972. Examples of particularly suitable yellow couplers are shown in the following Table:

Y1

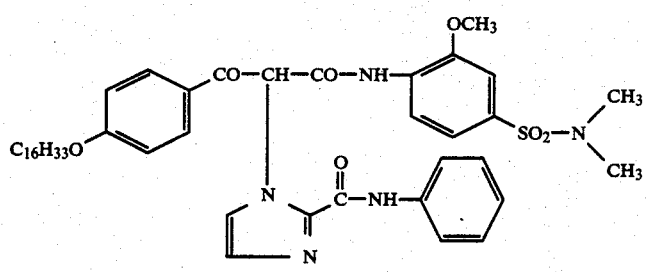

Y2

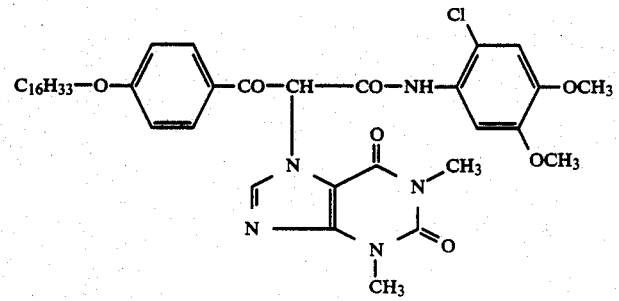

-continued
Y3
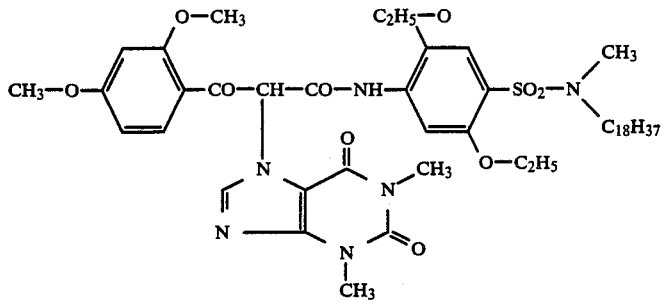
Y4
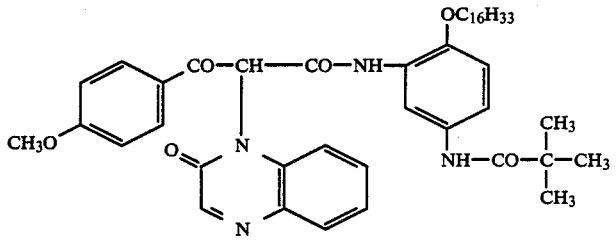
Y5
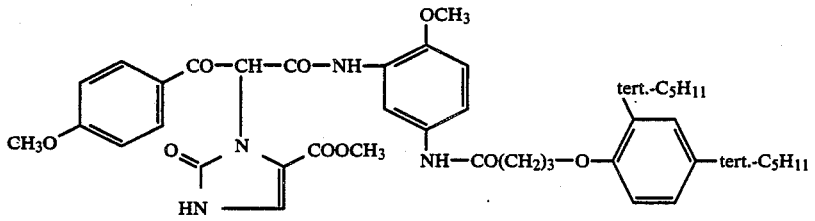
Y6
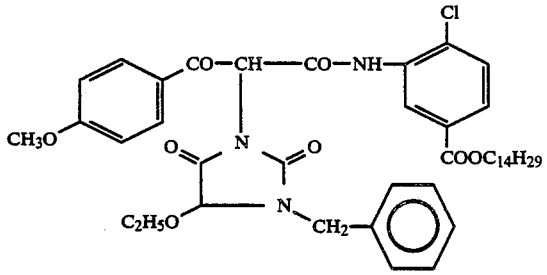
Y7
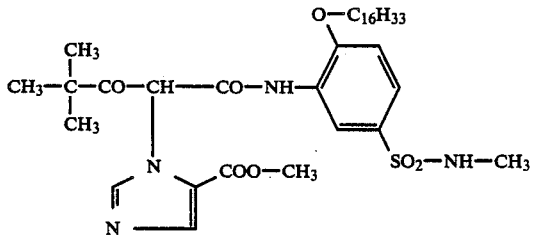
Y8
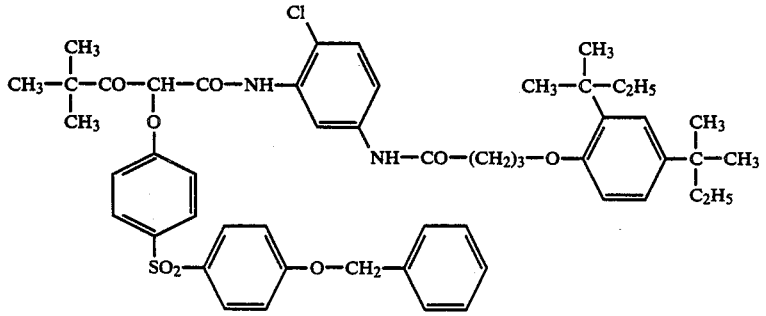

-continued
Y9
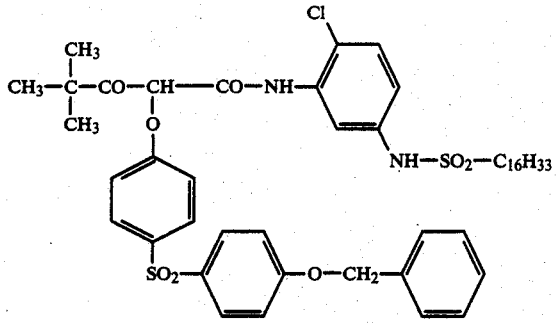
Y10
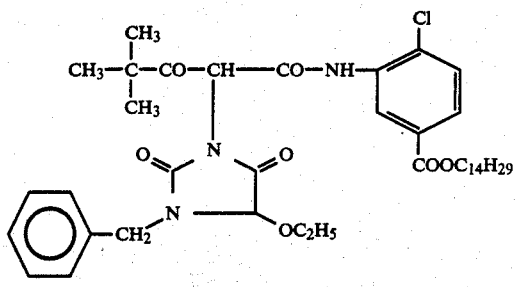
Y11
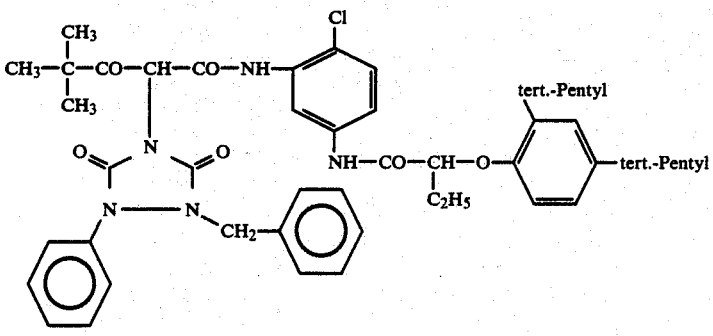
Examples of particularly suitable cyan couplers are shown in the following Table:
C1
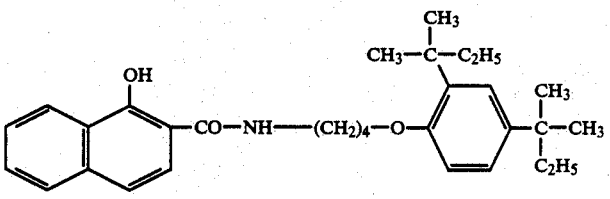
C2
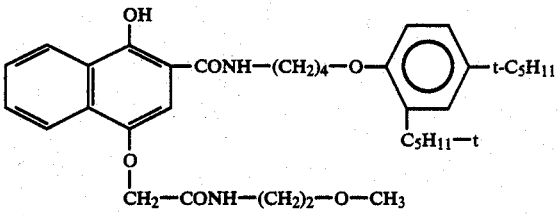
C3
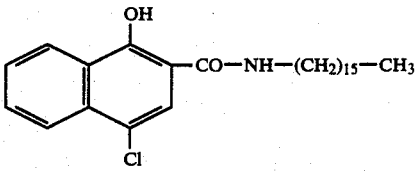
C4
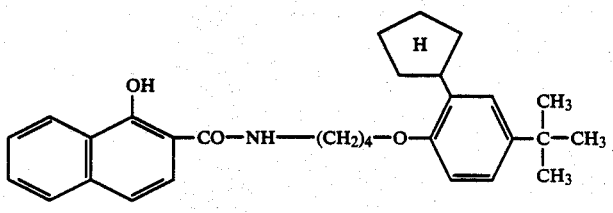

-continued

C5

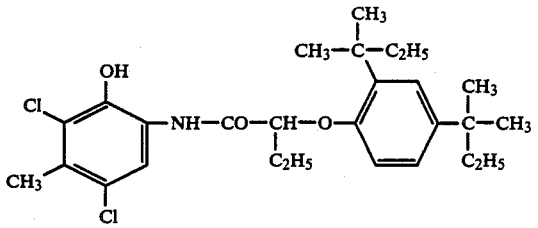

C6

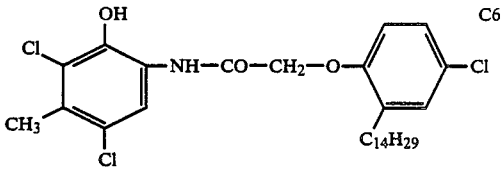

C7

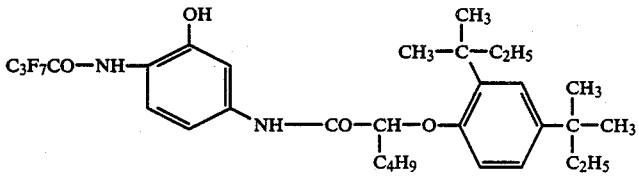

C8

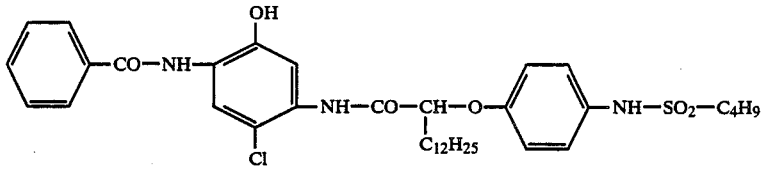

C9

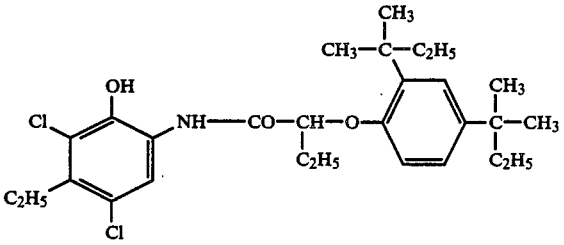

C10

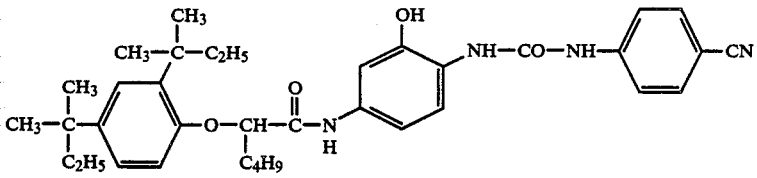

Typical magenta couplers are shown in the following:

M1

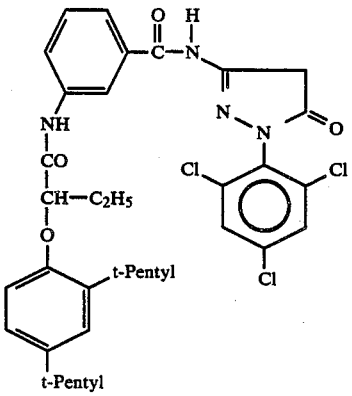

-continued

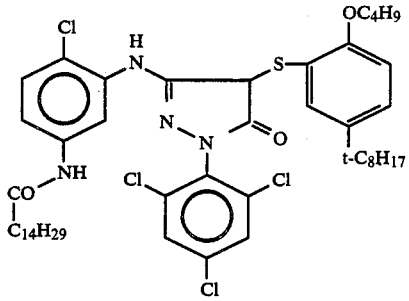

The photosensitive silver halide emulsions used may contain chloride, bromide and iodide or mixtures thereof as halide. In one preferred embodiment, 0 to 12% of the halide of at least one layer consists of AgI, 0 to 50 mole % of AgCl and 50 to 100% of AgBr. In another preferred embodiment, the crystals are predominantly compact crystals which are, for example, cubic or octahedral or have transitional forms. They may be characterized by the fact that they mostly have a thickness of greater than 0.2 μm. The average ratio of diameter to thickness is preferably less than 8:1, the diameter of a crystal being defined as the diameter of a circle with an area corresponding to the projected area of the crystal. In another preferred embodiment, however, all the emulsions or individual emulsions may even contain substantially tablet-form silver halide crystals in which the ratio of diameter to thickness is greater than 8:1. The emulsions may be monodisperse emulsions which preferably have an average grain size of from 0.3 μm to 1.2 μm. The silver halide grains may have a layered grain structure.

The emulsions may be chemically sensitized. The usual sensitizers may be used for chemically sensitizing the silver halide grains, sulfur-containing compounds, for example allylisothiocyanate, allylthiourea and thiosulfates, being particularly preferred. Other suitable chemical sensitizers are noble metals and noble metal compounds, such as gold, platinum, palladium, iridium, ruthenium or rhodium. This method of chemical sensitization is described in the Article by R. Koslowsky in Z. Wiss. Phot. 46, 65–72 (1951). The emulsions may also be sensitized with polyalkylene oxide derivatives. Other methods of sensitization are described in the above-mentioned Research Disclosure No. 17 643, Section III.

The emulsions may be optically sensitized in known manner, for example with the usual polymethine dyes, such as neutrocyanines, basic or acidic carbocyanines, rhodacyanines, hemicyanines, styryl dyes, oxonols and the like. Sensitizers such as these are described by F. M. Hamer in "The Cyanine Dyes and Related Compounds", (1964). Particular reference in this connection is made to Ullmanns Enzyklopadie der technischen Chemie, 4th Edition, Vol. 18, pages 431 et seq and to the above-mentioned Research Disclosure No. 17 643, Section IV.

The usual antifogging agents and stabilizers may be used. Particularly suitable stabilizers are azaindenes, preferably tetra- or pentaazaindenes, especially those substituted by hydroxyl or amino groups. Compounds such as these are described, for example, in the Article by Birr in Z. Wiss. Phot. 47, (1952), pages 2–58. Other suitable stabilizers and antifogging agents are described in the above-mentioned Research Disclosure No. 17 643, Section IV. Suitable compounds for improving resistance to formalin are described in U.S. Ser. No. 464 463.

The recording material may contain stabilizers against visible and UV light and for improving stability in storage which may optionally be present in polymeric form. Particularly good stabilizers of this type are, for example, aminoallylidene malonitriles.

The additional constituents of the photographic material may be incorporated by known methods. If the compounds in question are water-soluble or alkali-soluble compounds, they may be added in the form of aqueous solutions, optionally with addition of water-miscible organic solvents, such as ethanol, acetone or dimethyl formamide. If the compounds in question are insoluble in water and alkalis, they may be incorporated in the recording materials in known manner in dispersed form. For example, a solution of these compounds in a low-boiling organic solvent may be directly mixed with the silver halide emulsion or first with an aqueous gelatin solution and the organic solvent subsequently removed. The resulting dispersion of the particular compound may then be mixed with the silver halide emulsion. It is also possible additionally to use so-called oil formers, generally relatively high boiling organic compounds which include the compounds to be dispersed in the form of oily droplets. In this connection, reference is made, for example, to U.S. Pat. Nos. 2,322,027, 2,533,514, 3,689,271, 3,764,336 and 3,764,797. It is also possible, for example, to incorporate couplers in the form of loaded latices, cf. DE-OS No. 25 41 274 and EP-A No. 14 921. In addition, the constituents may also be fixed as polymers in the material, cf. for example DE-OS No. 2 044 992, U.S. Pat. Nos. 3,370,952 and 4,080,211.

The usual layer supports may be used for the materials according to the invention, for example supports of cellulose esters, for example cellulose acetate, and of polyesters. Other suitable supports are paper supports which may optionally be coated, for example with polyolefins, more particularly with polyethylene or polypropylene. Reference is made in this connection to the above-cited Research Disclosure No. 17 643, Section XVII.

Suitable protective colloids or rather binders for the layers of the recording material are the usual hydrophilic film-forming agents, for example proteins, more especially gelatin. Casting aids and plasticizers may be used. Reference is made in this connection to the compounds mentioned in the above-cited Research Disclosure No. 17 643, Sections IX, XI and XII.

The layers of the photographic material may be hardened in the usual way, for example with hardeners of the epoxide type, the heterocyclic ethylene imine type and the acryloyl type. The layers may also be hardened by the process according to DE-OS No. 2 218 009 in order to obtain color photographic materials which are suitable for high-temperature processing. It is also possible to harden the photographic layers or rather the color photographic multilayer materials with hardeners of the diazine, triazine or 1,2-dihydroquinoline series or with hardeners of the vinylsulfone type. Other suitable hardeners are known from DE-OS Nos. 2439 551, 2 225 230 and 2 317 672 and from the abovementioned Research Disclosure No. 17 643, Section XI.

Hardening is preferably regulated in such a way that the swelling of the layers in water (10° dH=German hardnes) at 38° C. (5 mins.) does not fall below 2.3–2.6 and a wet scratch resistance sufficient for processing is obtained.

Other suitable additives are mentioned in Research Disclosure No. 17 643 and in Product Licensing Index, December 1971, pages 107 to 110.

Suitable color developers for the material according to the invention are, in particular, those of the p-phenylene diamine type, for example 4-amino-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-N-ethyl-N-(2-methoxyethyl)-m-toluidine di-p-toluene sulfonic acid and N-ethyl-N-β-hydroxyethyl-p-phenylene diamine. Other suitable color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out either separately from or together with one another. Suitable bleaches are the usual compounds, for example $Fe^{3+}$ salts and $Fe^{3+}$ complex salts, such as ferricyanides, dichromates, water-soluble cobalt complexes etc. Particularly suitable bleaches are iron(III)

complexes of aminopolycarboxylic acids, more especially for example ethylene diamine tetraacetic acid, nitrilotriacetic acid, iminodiacetic acid, N-hydroxyethyl ethylene diamine triacetic acid, alkyliminodicarboxylic acids and of corresponding phosphonic acids. Other suitable bleaches are persulfates.

In addition to the polymers and couplers already mentioned, the following compounds are used in the following Examples:

Masks

Red mask CC1:

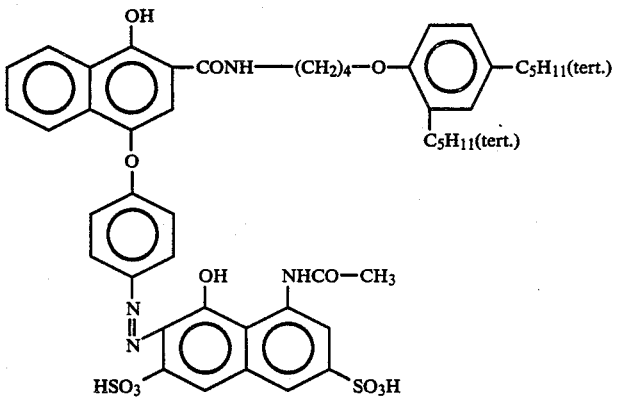

Yellow mask CC2:

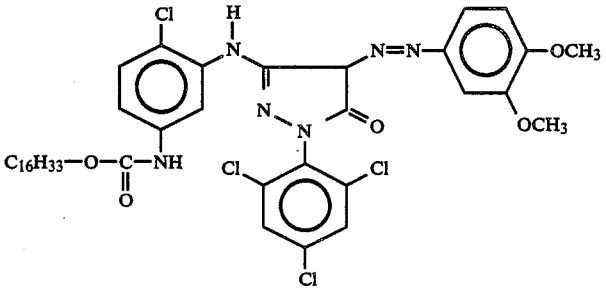

DIR-coupler

DIR1

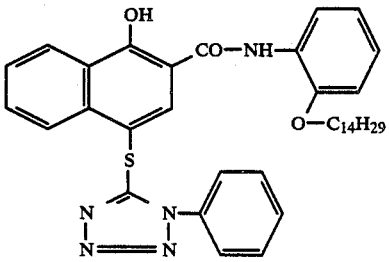

DIR2

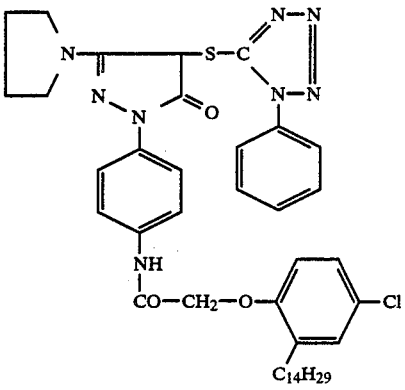

DIR3

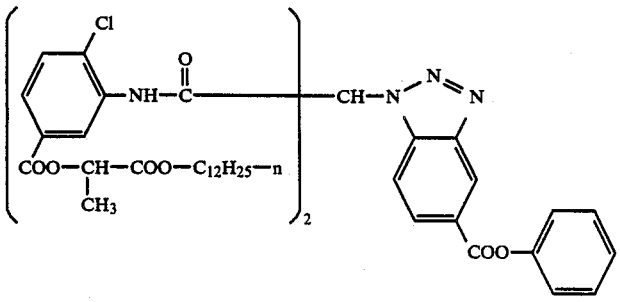

-continued

DIR4

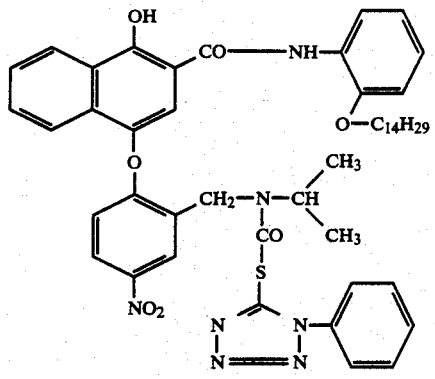

DIR5

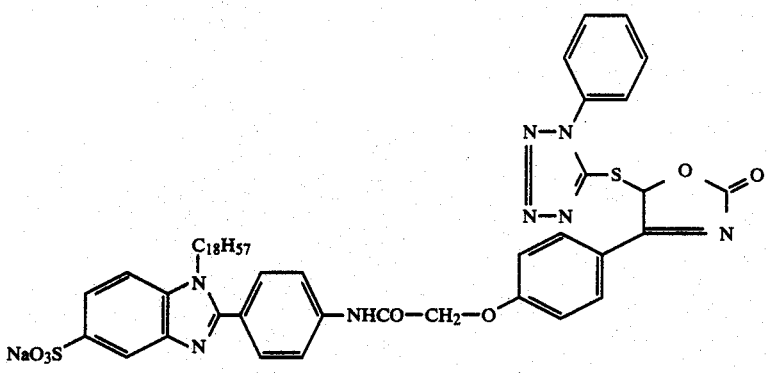

DAR coupler

DAR1

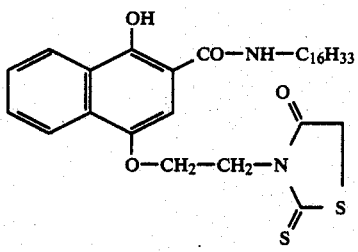

EXAMPLE 1

The following variants 1A, 1B, 1C and 1D of layer compositions are prepared.

1A—is a comparison type without addition of polymer.

1B—is a comparison type in which polymers are added not only to the partial layers of high sensitivity, but also to the partial layers of low sensitivity.

1C—in accordance with the invention contains the polymer P8 in the partial layers of high sensitivity:

RR=layer No. 4
GG=layer No. 7
BB=layer No. 11
in a ratio by weight of polymer to gelatin of 1:1.

The color coupler is present in emulsified form, as in 1A and 1B.

1D—in accordance with the invention contains the following polymers charged with color couplers in the partial layers of high sensitivity:

RR=layer 4: P1
GG=layer 7: P2
BB=layer 11: P3

To prepare these four variants, the following layers were applied in the order indicated to a transparent layer support of cellulose triacetate.

The quantities indicated are always based on 1 square meter. For the silver halide coating, the corresponding quantities of $AgNO_3$ are quoted.

All the silver halide emulsions of this material were stabilized with 0.5 g of 4-hydroxy-6-methyl-1,3,3a,7-tetraazaindene per 100 g of $AgNO_3$.

1st layer: (antihalo layer) Black colloidal silver sol containing 1.5 g of gelatin and 0.33 g of Ag
2nd layer: (intermediate layer) 0.6 g gelatin
3rd layer: (low-sensitivity, red-sensitized layer)

In this third layer, the three variants 1A, 1C and 1D each contained 3.0 g of an Ag(Br,I) emulsion containing 4 mole % iodide, average grain diameter=0.45 μm, spectrally sensitized for the red spectral region, and 2.0 g of gelatin. This third layer also contained 0.6 g of cyan coupler C1, emulsified (1 part by weight of coupler with 0.5 part by weight of oil former) and in addition 50 mg of red mask CC1 and 25 mg of DIR 1.

In variant 1B, the third layer contained the constituents mentioned here in a quantity reduced by a factor of 0.8 to obtain the same gradation; in addition, this third layer contained 1.6 g of P8.

4th layer: (high-sensitivity, red-sensitized layer)

Variant 1A 2.8 g of an Ag(BR,I)-emulsion containing 8.5 mole % iodide, average grain diameter=0.8 μm, spectrally red-sensitized, 1.8 g gelatin and 0.15 g of the cyan coupler C2, emulsified (1 part by weight of the color coupler with 1 part by weight of dibutyl phthalate).

Variants 1B, 1C and 1D contained these constituents in the fourth layer in a quantity reduced by a factor of 0.6 to produce the same gradation; in addition, this fourth layer contained 0.9 g of P8 in variants 1B and 1C. Instead of the emulsified cyan coupler, variant 1D contained 0.9 g of polymer P1 which was charged with the cyan coupler C2 in a ratio by weight of 1 part of coupler to 8 parts of polymer.

5th layer: (intermediate layer) 0.7 g of gelatin and 0.2 g 2,5-diisooctylhydroquinone 6th layer: (low-sensitivity, green-sensitized layer)

In this sixth layer, the three variants 1A, 1C and 1D each contained 2.5 g $AgNO_3$ of an Ag(Br,I)-emulsion containing 4.5 mole % iodide, average grain diameter=0.4 μm, spectrally green-sensitized, and 1.5 g gelatin. In addition, this sixth layer contained 0.6 g of the magenta coupler M1, emulsified (1 part by weight color coupler emulsified with 1 part by weight tricresyl phosphate), 20 mg of the yellow mask CC2 and 7.5 mg of the DIR coupler DIR2.

In variant 1B, the sixth layer contained the constituents mentioned here in a quantity reduced by a factor of 0.85 to produce the same gradation; in addition, this layer contained 1.3 g of P8.

7th layer: (high-sensitivity, green-sensitized layer)

Variant 1A 2.5 g of an Ag(Br,I)-emulsion containing 7.0 mole % iodide, average grain diameter=0.70 μm, spectrally green-sensitized, 1.4 g gelatin, 0.15 g of the same magenta coupler M1 as in layer No. 6, emulsified in the same way, and 0.02 g of the same yellow mask coupler CC2.

Variants 1B, 1C and 1D contained these constituents in the seventh layer in a quantity reduced by a factor of 0.8 to produce the same gradation; in addition, this seventh layer contained 1.1 g of P8 in variants 1B and 1C.

Instead of the emulsified magenta coupler, variant 1D contained 1.1 g of polymer P2 which was charged with the magenta coupler M1 in a ratio by weight of 1 part of coupler to 8 parts of polymer.

8th layer: (intermediate layer) 0.5 g gelatin and 0.15 g 2,5-diisooctylhydroquinone 9th layer: (yellow filter layer) yellow colloidal silver sol containing 0.2 g Ag and 0.9 g gelatin 10th layer: (low-sensitivity, blue-sensitive layer)

In this tenth layer, the three variants 1A, 1C and 1D each contained 0.75 g of a spectrally blue-sensitized Ag(Br,I)-emulsion containing 4.9 mole % iodide, average grain diameter=0.45 μm, and 0.85 g of gelatin. In addition, this tenth layer contained 0.7 g of yellow coupler Y1, emulsified with tricresyl phosphate in a ratio by weight of 1:1, and 0.15 g of the DIR-coupler DIR3.

In variant 1B, the tenth layer contained these constituents in a quantity reduced by a factor of 0.75 to produce the same gradation, and in addition 0.6 g of P8.

11th layer: (high-sensitivity, blue-sensitive layer)

Variant 1A 1.0 g of a spectrally blue-sensitized Ag(Br,I)-emulsion containing 9.0 mole % AgI, average grain diameter=0.9 μm, 0.85 g gelatin and 0.3 g of the same yellow coupler Y1 as in layer 10 emulsified in the same way.

In variants 1B, 1C and 1D, the eleventh layer contained these constituents in a quantity reduced by a factor of 0.7 to produce the same gradation: this eleventh layer additionally contained 0.6 g of P8 in variants 1B and 1C.

Instead of the emulsified yellow coupler, variant 1D contained 0.65 g of the polymer P3 which was charged with the yellow coupler Y1 in a ratio by weight of 1 part of coupler to 8 parts of polymer.

12th layer: (protective layer) 1.2 g of gelatin 0.5 g of a standard UV-absorber.

13th layer: (hardening layer) 1.5 g of gelatin and 0.7 g of a standard hardener

These four variants 1A, 1B, 1C and 1D are merely intended to demonstrate how effective it is for the sharpness and graininess of color negative material if these polymers (charged with photographically active constituents, such as color couplers for example, or even not charged) are only incorporated in the highly sensitive partial layers.

The materials were exposed to white light behind a wedge and then processed by the color-negative process described in "The British Journal of Photography" (1974), pages 597 and 598. The color graininess ($\sigma_D$) was then measured at various color densities by the method described by T. H. James in "The Theory of the Photographic Process", 4th Edition, Macmillan Publ. Co Inc., New York/London (1977) pp. 618–621.

Table B1/I below shows the color graininess of the different variants measured at the color densities of 0.5, 1.0 and 1.5 over fog.

TABLE B1/I

| | color density over fog | ←comparison→ Variant 1A | Variant 1B | ←invention→ Variant 1C | Variant 1D |
|---|---|---|---|---|---|
| Color: | | Color graininess ($\sigma_D \times 10^2$) | | | |
| Cyan | 0.5 | 1.0 | 1.0 | 1.1 | 1.0 |
| | 1.0 | 1.4 | 0.9 | 1.0 | 1.0 |
| | 1.5 | 1.3 | 0.8 | 0.9 | 0.8 |
| Magenta | 0.5 | 1.8 | 0.8 | 1.0 | 1.0 |
| | 1.0 | 1.4 | 0.9 | 1.0 | 0.9 |
| | 1.5 | 1.3 | 0.7 | 1.1 | 0.8 |
| Yellow | 0.5 | 4.2 | 1.8 | 3.0 | 3.2 |
| | 1.0 | 3.8 | 2.1 | 2.9 | 3.0 |
| | 1.5 | 3.5 | 2.2 | 2.8 | 2.8 |
| Polymer No. in high-sensitivity partial layers | | / | P8 | P8 | P1, P2, P3 |
| in low-sensitivity partial layers | | / | P8 | P8 | P1, P2, P3 |
| | | / | P8 | / | / |

Determination of sharpness

Sharpness is determined using the modulation-transfer function (MTF) by the method described in T. H. James "The Theory of the Photographic Process", 4th Edition, Macmillan Publ. Co Inc., New York/London (1977) p. 605.

The local frequencies at which the MTF has a value of 75%, 50% and 25% are cited here in lines per mm. The greater image sharpness of the variants according to the invention is reflected in the higher local frequencies at which the MTF reaches these percentage values.

Table B1/II shows the sharpness values of the different variants of Example 1.

TABLE B1/II

| | | Lines/mm at which MTF = 75%, 50% or 25% | | | |
|---|---|---|---|---|---|
| | | ←comparison→ | | ←invention→ | |
| Color: | % MTF | Variant 1A | Variant 1B | Variant 1C | Variant 1D |
| Cyan | 75% | 18 | 9 | 21 | 22 |
| | 40% | 28 | 12 | 31 | 33 |
| | 25% | 40 | 22 | 47 | 50 |
| Magenta | 75% | 33 | 14 | 34 | 33 |
| | 50% | 52 | 24 | 54 | 58 |
| | 25% | 75 | 57 | 84 | 84 |
| Yellow | 75% | 40 | 18 | 42 | 42 |
| | 50% | 58 | 32 | 64 | 66 |
| | 25% | 85 | 62 | 88 | 90 |

Comparison of the values set out in Table B1/I and B1/II shows that, where polymeric compounds are used in accordance with the invention, color graininess is reduced and, at the same time, sharpness increased. If the polymeric compound is added to all the layers (which does not correspond to the invention), color graininess is certainly reduced, but at the same time sharpness falls to a level at which the photographic material is of virtually no use (IB).

EXAMPLE 2

Eight variants 2A to 2H of layer compositions are prepared

Of these different variants, variants 2A to 2D are comparison variants without the addition of polymers according to the invention. The high-sensitivity partial layers of these comparison variants contain in 2A: neither DIR- nor DAR-couplers, in 2B: DIR-couplers in 2C: DAR-couplers in 2D: DAR- and DIR-couplers.

The four variants 2E to 2H correspond to these four variants 2A to 2D, but in accordance with the invention contain additions of the above-mentioned polymers in the high-sensitivity partial layers in the form of mixtures of uncharged polymers with polymers charged with color couplers.

The average-sensitivity and low-sensitivity partial layers and also the separation layers and filter layers are the same in all eight variants. Differences only occur from the thirteenth layer.

To prepare these eight variants, the following layers were applied in the order indicated to a transparent layer support of cellulose triacetate.

The quantities indicated are all based on 1 square meter. For the silver halide coating, the corresponding quantities of $AgNO_3$ are cited.

All the silver halide emulsions of this material wee stabilized with 0.5 g of 4-hydroxy-6-methyl-1,3,3a,7-tetraazaindene per 100 g of $AgNO_3$.

1st layer: (antihalo layer) black colloidal silver sol containing 1.5 g gelatin and 0.33 g Ag 2nd layer: (micrate intermediate layer) 0.6 g gelatin and 0.2 g of an Ag(Br,I)-micrate emulsion containing 1.5 mole % iodide, average grain diameter=0.05 μm.

3rd layer: (low-sensitivity, red-sensitized layer) Same composition as the third layer of Example 1, variants 1A, 1C and 1D.

4th layer: intermediate layer containing 0.6 g gelatin and 0.2 g of the same cyan coupler C1 as in the third layer.

5th layer: (medium-sensitivity, red-sensitized layer)

2.0 g of red-sensitized Ag(Br,I)-emulsion, 6 mole % iodide, average grain diameter=0.7 μm, 1.2 g gelatin, 0.3 g of cyan coupler C1, 40 mg of the red mask CC1 and 20 mg of the same DIR-coupler DIR1.

6th layer: intermediate layer 0.6 g gelatin and 0.2 g diisooctyl hydroquinone.

7th layer: (low-sensitivity, green-sensitized layer) Same composition as the sixth layer in Example 1, variants 1A, 1C and 1D.

8th layer: intermediate layer containing 0.6 g gelatin, 0.2 g of magenta coupler M1 and 0.05 g of yellow mask CC2.

9th layer: (medium-sensitivity, green-sensitized layer)

1.2 g of a spectrally green-sensitized Ag(Br,I)-emulsion containing 4.0 mole % iodide, average grain diameter 0.8 μm, 0.75 g gelatin, 0.18 g of the same magenta coupler, 0.04 g of the same yellow mask and 0.02 g of the same DIR coupler as in the seventh layer.

10th layer: (yellow filter layer)

Yellow colloidal silver sol containing 0.1 g Ag, 0.5 g gelatin and 0.1 g 2,5-diisooctylhydroquinone. The yellow silver sol was stabilized with a phenyl mercaptotetrazole.

11th layer: low-sensitivity, blue-sensitive layer 0.8 g of blue-sensitized Ag(Br,I)-emulsion (5 mole % iodide), average grain diameter=0.5 μm, 0.9 g gelatin and 0.7 g yellow coupler Y1, emulsified with tricresyl phosphate in a ratio by weight of 1:1, and 150 mg of DIR coupler DIR3.

12th layer: intermediate layer Same composition as the fourth layer.

13th layer: high-sensitivity, red-sensitized layer

Variant 2A

Red-sensitized Ag(Br,I)-emulsion, 8 mole % iodide, average grain diameter=1.0 μm, containing 2.8 g $AgNO_3$, 1.6 g gelatin and 0.15 g of cyan coupler C10.

Variant 2B

Same emulsion as in 2A, but with a silver coating of 3.2 g, 2.0 g gelatin and 0.15 g of cyan coupler C2; also 0.06 g of DIR coupler DIR4.

Variant 2C

Same composition as 2A with, in addition, 0.01 g of DAR coupler DAR1.

Variant 2D

Same composition as the DIR-coupler-containing variant 2B, but additionally containing 0.01 g of the same DAR coupler DAR1.

In variants 2E to 2H, the high-sensitivity cyan layer (=thirteenth layer) contains the same constituents as variants 2A to 2D, but in a quantity reduced by a factor of 0.65 to produce the same gradation. In addition, the emulsified cyan coupler was replaced by 0.2 g of the polymer P4 charged with cyan coupler in a ratio by weight of 1:1 and mixed with 1.5 g of the uncharged polymer P7.

14th layer: intermediate layer Same composition as the fourth layer.

15 layer: high sensitivity, green-sensitized layer

Variant 2A 3.0 g green-sensitized Ag(Br,I)-emulsion, 7.5 mole % iodide, average grain diameter 1.1 μm, 1.8 g gelatin and 0.16 g of magenta coupler M2 emulsified with tricresyl phosphate in a ratio by weight of 1:1.

Variant 2B

Same emulsion as in 2A, but with a silver coating of 3.4 g, 2.2 g gelatin and 0.16 g of the same magenta coupler as in 2A, emulsified in the same way, and in addition 0.05 g of DIR coupler DIR5.

Variant 2C

Same composition as variant 2A, but additionally containing 0.01 g of DAR coupler DAR1.

Variant 2D

Same composition as variant 2B, but additionally containing 0.01 g of DAR coupler DAR1.

In variants 2E to 2H, the high-sensitivity magenta layer (fifteenth layer) contains the same constituents as variants 2A to 2D, but in a quantity reduced by a factor of 0.85 to produce the same gradation. In addition, the emulsified magenta coupler was replaced by 0.2 g of polymer P5 charged with magenta coupler M2 in a ratio by weight of 1:1 and mixed with 1.6 g of P7.

16th layer: (yellow filter layer) Same composition as the tenth layer.

17th layer: high-sensitivity, blue-sensitized layer

Variant 2A 0.8 g of a spectrally blue-sensitized Ag(Br,I)-emulsion containing 10.5 mole % iodide, average grain diameter 1.2 μm, 0.9 g gelatin and 0.25 g of yellow coupler Y1 as in the eleventh layer, emulsified in the same way.

Variant 2B 1.2 g of the same emulsion as in 2A, 1.0 g gelatin, 0.25 g of yellow coupler Y1 emulsified in the same way as in 2A, additionally containing 0.1 g of DIR coupler DIR3.

Variant 2C

Same composition as variant 2A, but additionally containing 0.01 g of DAR coupler DAR1.

Variant 2D

Same composition as variant 2B, but additionally containing 0.01 g of DAR coupler DAR1.

In variants 2E to 2H, the high-sensitivity yellow layer (seventeenth layer) contains the same constituents as variants 2A to 2D, but in a quantity reduced by a factor of 0.75 to produce the same gradation. In addition, the emulsified yellow coupler was replaced by 0.4 g of polymer P6 charged with the yellow coupler Y1 in a ratio by weight of 1:1 and mixed with 0.8 g of P7.

18th layer: (hardening layer) 1.5 g gelatin, 0.9 g of a standard hardener and 0.5 g of a standard UV-absorber.

Color graininess and sharpness were determined as in Example 1 and are shown in the following Tables.

In regard to photographic sensitivity, an increase in the sensitivity value by 3 units corresponds to a doubling of sensitivity.

TABLE B2/I

| Color: | Color density over fog | Variant 2A | Variant 2B | Variant 2C | Variant 2D | Variant 2E | Variant 2F | Variant 2G | Variant 2H |
|---|---|---|---|---|---|---|---|---|---|
| | | | | | Color graininess ($\sigma_D \times 10^2$) | | | | |
| Cyan | 0.5 | 2.4 | 2.0 | 3.0 | 2.6 | 1.3 | 1.0 | 1.4 | 1.2 |
| | 1.0 | 1.6 | 1.7 | 1.8 | 1.7 | 1.2 | 1.2 | 1.3 | 1.3 |
| | 1.4 | 1.4 | 1.5 | 1.6 | 1.5 | 1.1 | 1.2 | 1.2 | 1.1 |
| Magenta | 0.5 | 2.2 | 2.0 | 2.9 | 2.5 | 1.1 | 1.0 | 1.2 | 1.1 |
| | 1.0 | 1.7 | 1.9 | 2.3 | 2.0 | 1.2 | 1.2 | 1.2 | 1.0 |
| | 1.5 | 1.5 | 1.7 | 1.9 | 1.9 | 1.2 | 0.9 | 1.1 | 1.0 |
| Yellow | 0.5 | 5.0 | 4.9 | 6.5 | 5.2 | 2.1 | 2.0 | 2.2 | 2.2 |
| | 1.0 | 4.5 | 4.4 | 5.0 | 4.6 | 3.3 | 3.0 | 3.4 | 3.3 |
| | 1.5 | 4.0 | 4.0 | 4.0 | 4.1 | 3.5 | 3.4 | 3.4 | 3.4 |
| | | | | | Photographic sensitivities | | | | |
| Yellow | | 28.2 | 28.1 | 30.4 | 30.3 | 28.3 | 28.0 | 31.5 | 31.4 |
| Magenta (DIN): | | 28.0 | 27.6 | 31.1 | 31.0 | 28.4 | 27.5 | 31.0 | 30.7 |
| Cyan | | 27.6 | 27.4 | 30.2 | 29.8 | 27.8 | 27.5 | 30.0 | 29.8 |
| Polymer in high-sensitivity layers | | — | — | — | — | x | x | x | x |

It can be seen from the values quoted above that, by adding DIR coupler in the variant according to the invention (2F), color graininess can be further reduced and sharpness increased. By the combined use of DIR and DAR couplers in the variant according to the invention (2H), an increase in sensitivity is additionally obtained for low graininess and high sharpness.

We claim:

1. In a color photographic recording material comprising at least one silver halide emulsion layer which is divided into a relatively low-sensitive partial layer L and at least one more sensitive partial layer H,
   - at least one color coupler being associated with the partial layers H and L,
   - a synthetic polymer P consisting of at least one synthetic polymer with a glass transition temperature of below 25° C. contained in said partial layer H and gelatin contained in said partial layer H,
   - the ratio by weight of all the polymers P and gelatin in partial layer H being from 40:60 to 80:20,
   - and the partial layer L contains a synthetic polymer P in a range by weight of from 0 to a ratio of polymer P to gelatin of lower than 25:75.

2. A color photographic recording material as claimed in claim 1, characterized in that the layer H contains at least one low molecular weight color coupler.

3. A color photographic recording material as claimed in claim 1, characterized in that at least one emulsion layer sensitized to another spectral region is present between at least one partial layer H and at least one partial layer L.

4. A color photographic recording material as claimed in claim 1, characterized in that the polymer is a high molecular weight polymerization, polycondensation or polyaddition product.

5. A color photographic recording material as claimed in claim 1, characterized in that the polymer is completely or predominantly a nonionic or anionic polyurethane.

6. A color photographic recording material as claimed in claim 1, characterized in that the polymer is a polymer latex and is at least partly loaded with a color coupler.

7. A color photographic recording material as claimed in claim 1, characterized in that the polymer P is present in dispersion form with an average particle size of from 20 to 2000 nm.

8. A process for producing color photographic images by imagewise exposure of the material claimed in claim 1 and development in a developer bath containing at least one p-phenylene diamine.

* * * * *